US009193523B2

(12) United States Patent
Mino et al.

(10) Patent No.: US 9,193,523 B2
(45) Date of Patent: Nov. 24, 2015

(54) REINFORCING OR RESTRAINING STRAP OR GUSSET SYSTEM FOR REAR WALL MEMBER OF BULK MATERIAL CARGO CONTAINER LINER

(75) Inventors: Oswaldo Mino, Houston, TX (US); Pablo Llopez-Miquel, Kingwood, TX (US); Michael J. McMahon, Palatine, IL (US); Stanley Piotrowski, Addison, IL (US)

(73) Assignee: SIGNODE INDUSTRIAL GROUP, Glenview, IL (US)

( * ) Notice: Subject to any disclaimer, the term of this patent is extended or adjusted under 35 U.S.C. 154(b) by 1174 days.

(21) Appl. No.: 11/798,134

(22) Filed: May 10, 2007

(65) Prior Publication Data

US 2007/0267410 A1 Nov. 22, 2007

Related U.S. Application Data

(60) Provisional application No. 60/801,376, filed on May 19, 2006.

(51) Int. Cl.
*B65D 88/00* (2006.01)
*B65D 90/04* (2006.01)

(52) U.S. Cl.
CPC ..... *B65D 90/048* (2013.01); *B65D 2590/046* (2013.01)

(58) Field of Classification Search
CPC ... B65D 90/046; B65D 90/047; B65D 90/048
USPC ..... 220/1.6, 495.01, 495.06, 495.05; 296/39.1; 105/423; 160/368.1; 414/467
See application file for complete search history.

(56) References Cited

U.S. PATENT DOCUMENTS

| | | | | |
|---|---|---|---|---|
| 3,980,196 | A * | 9/1976 | Paulyson et al. | 220/1.5 |
| 4,601,405 | A * | 7/1986 | Riemer | 220/1.5 |
| 5,137,170 | A | 8/1992 | Matias | |
| 5,222,621 | A | 6/1993 | Matias | |
| 5,421,476 | A | 6/1995 | Matias | |
| 5,542,563 | A | 8/1996 | Matias | |
| 5,657,896 | A | 8/1997 | Matias | |
| 6,209,768 | B1 * | 4/2001 | Boaz | 224/314 |
| 6,250,488 | B1 * | 6/2001 | Narahara et al. | 220/1.6 |
| 2005/0040163 | A1 * | 2/2005 | Siegers et al. | 220/1.6 |

* cited by examiner

*Primary Examiner* — Jeffrey Allen
(74) *Attorney, Agent, or Firm* — Law Offices of Steven W. Weinrieb

(57) ABSTRACT

An external reinforcing strap system for a bulk material cargo container liner comprises a plurality of vertically spaced, horizontally oriented reinforcing straps, or a plurality of horizontally spaced, vertically oriented reinforcing straps and a plurality of vertically spaced, horizontally oriented reinforcing straps, to have their tension levels individually adjusted in an independent manner in order to provide selected sections of the external reinforcing strapping system with requisites amount of tension. In addition, a substantially U-shaped reinforcing gusset system is also disclosed which provides the necessary reinforcement for the rear wall member of the bulk material cargo container liner but with a simplified structure effectively eliminating the aforenoted strapping system.

20 Claims, 6 Drawing Sheets

REINFORCING OR RESTRAINING STRAP OR GUSSET SYSTEM FOR REAR WALL MEMBER OF BULK MATERIAL CARGO CONTAINER LINER

CROSS-REFERENCE TO RELATED PATENT APPLICATION

This patent application is related to, based upon, and effectively a utility patent application conversion from U.S. Provisional Patent Application Ser. No. 60/801,376, which was filed on May 19, 2006, the priority and filing date benefits of which are hereby claimed.

FIELD OF THE INVENTION

The present invention relates generally to bulk material cargo containers within which fluid-like or flowable bulk cargo materials, such as, for example, dry bulk chemicals, powdered and pelletized resins, flour, coffee beans, grain, and the like, are to be housed or contained while being shipped, transported, or stored, and more particularly to a new and improved bulk material cargo container liner, for use within such bulk material cargo containers, wherein the new and improved bulk material cargo container liner has operatively associated therewith a new and improved external strapping or gusset restraint system which effectively forms a bulkhead structure upon or for the rear end wall member of the bulk material cargo container liner so as to effectively reinforce or restrain the rear end wall member of the bulk material cargo container liner whereby the rear end wall member of the bulk material cargo container lines will experience less rearwardly oriented outward bulging, under the influence of the substantially large hydrostatic head that may be impressed upon the rear end wall member of the bulk material cargo container liner by means of the bulk cargo material which has been charged into or deposited within the bulk material cargo container liner.

BACKGROUND OF THE INVENTION

Bulk material cargo containers are conventionally utilized, at different times, to house or contain different fluid-like or flowable bulk cargo materials, such as, for example, dry bulk chemicals, powdered and pelletized resins, coffee beans, flour, grains, rice, sugar, and the like. The bulk material cargo containers are integrally formed within, for example, the cargo holds of ships, trucks, railroad cars, and the like, whereby the bulk cargo materials can readily be shipped or transported from one location to another. Alternatively, the bulk material cargo containers are utilized to temporarily store bulk cargo materials at a particular location prior to the continued transportation or shipping of the bulk cargo materials, or still further, prior to the unloading or discharge of the bulk cargo materials from the bulk material cargo containers. Since different bulk cargo materials are shipped or transported within a particular bulk material cargo container at different times, it is imperative that the bulk material cargo containers effectively be clean so as not to contaminate the materials, comprising a particular bulk material cargo load, with any residual materials which may have remained within the bulk material cargo container from a previously shipped or transported bulk material cargo load. Accordingly, in order to eliminate the necessity of cleaning each bulk material cargo container after a particular bulk material cargo load has been unloaded or discharged from a particular one of the bulk material cargo containers, it has become conventional within the industry to employ removable bulk material container liners within the cargo holds or the bulk material cargo containers whereby, after a particular bulk material cargo load is delivered to its destination and discharged or unloaded, the bulk material cargo container liner is simply removed from the bulk material cargo container, thereby again rendering the bulk material cargo container usable for carrying another bulk material cargo load without requiring a significant amount of cleaning of the bulk material cargo container.

Examples of bulk material cargo container liners, as used within bulk material cargo containers for shipping or transporting fluid-like or flowable materials are disclosed within U.S. Pat. No. 5,657,896 which issued on Aug. 19, 1997 to Matias, U.S. Pat. No. 5,542,563 which issued on Aug. 6, 1996 to Matias, U.S. Pat. No. 5,421,476 which issued on Jun. 6, 1995 to Matias, U.S. Pat. No. 5,222,621 which issued on Jun. 29, 1993 to Matias, and U.S. Pat. No. 5,137,170 which issued on Aug. 11, 1992 to Matias. It is noted that each one of the aforenoted patents issued to Matias discloses an external strapping system for effectively reinforcing the rear wall member of the bulk material cargo container liner, and while the aforenoted removable bulk material cargo container liners, and their associated external strapping systems, have obviously performed satisfactorily from an overall point of view in connection with the achievement of their primary objectives, such removable bulk material cargo container liners, with their external strapping systems, exhibit several structural and operational drawbacks.

More particularly, as can best be seen from FIG. 1, which effectively corresponds to FIG. 16D to any one of the aforenoted Matias patents, it is seen that the external strapping system, characteristic of any one of the Matias patents, comprises a plurality of vertically spaced, horizontally oriented external reinforcing straps 66, and a plurality of horizontally spaced, vertically oriented external reinforcing straps 64 that are secured to the external surface portion of the rear end wall member 52 of the bulk material cargo container liner so as to effectively crisscross each other at a plurality of intersection locations 67 and thereby form a checkerboard arrangement that effectively divides the rear end wall member 52 into a plurality of sub-portions 53. The crisscrossed reinforcing straps 64, 66 are adapted to be fixedly connected together at their intersection locations 67 by suitable means, such as, for example, sewing, and the free end portions of the vertically spaced, horizontally oriented reinforcing straps 66 are adapted to be fixedly connected to oblique reinforcing straps 68 which may be connected to floor portions of the cargo container, as well as to cargo rings 60. It can therefore be readily appreciated that not only will some of the vertically spaced, horizontally oriented reinforcing straps 66, such as, for example, those horizontally oriented reinforcing straps 66 that are fixedly connected to the floor portions of the cargo container, not be able to be adjustably tensioned and then subsequently affixed to the floor portions of the cargo container so as to impart to such reinforcing straps 66 a requisite amount of tension in order to lessen catenary sag of such reinforcing straps 66 and the rear end wall member 52 of the cargo container liner, but in addition, similar structural drawbacks are characteristic of the horizontally spaced, vertically oriented reinforcing straps 67. Accordingly, while such a checkerboard arrangement of the reinforcing straps 64, 66 might well serve, for example, to prevent bursting of the rear end wall member 52 of the cargo container line, the lack of sufficient tension developed within all of the vertically spaced, horizontally oriented reinforcing straps 66, and within all of the horizontally spaced, vertically oriented reinforcing straps 64, does not effectively prevent the sagging or rearwardly directed outward bulging of the rear end wall member 52 of the cargo container liner whereby such disposition or state of the rear end wall member 52 of the cargo container liner can adversely impact upon the rear door members of the cargo container.

Furthermore, other conventional PRIOR ART bulk material cargo container liners utilize rigid bars that are disposed transversely across the external surface portion of the rear end wall member of the bulk material cargo container liner in order to effectively reinforce the same and prevent bursting or an outward bulging of the rear end wall member of the bulk material cargo container liner when subjected to the hydrostatic head forces characteristic of the bulk cargo material contained or disposed within the bulk material cargo container liner. While such a system is substantially satisfactory from a purely operational point of view, that is, from the perspective that the restraining bars satisfactorily reinforce the rear end wall member of the bulk material cargo container liner and restrain the same from impacting upon the rear doors of the bulk material cargo container, the restraining bars do present safety issues in that operator personnel must be extremely careful when standing behind the rear end wall member of the cargo container liner during the time that the operator personnel is monitoring the discharging sequence.

This is because the bars are pre-cut so as to have length dimensions of approximately ninety-four and one-half inches (94.50") which corresponds to the distance defined between the bar fixation positions located internally upon the bulk material cargo container. This distance is subject to tolerances or differences based upon various factors, such as, for example, the particular bulk material cargo container manufacturer, the year in which the bulk material cargo container was built, the width of the bulk material cargo container bar channel, the condition of the bulk material cargo container, and the like. These factors, along with the hydrostatic head forces characteristic of the bulk cargo material, can contribute to significant bending of the steel bars which could therefore harm the operator in case the same comes loose from their restrained positions within the bulk material cargo container channels.

A need therefore exists in the art for a new and improved bulk material cargo container liner, for use in conjunction with bulk material cargo containers, and within which bulk cargo materials are to be accommodated for shipping, transportation, and storage purposes, wherein the bulk material cargo container liner will comprise a new and improved external reinforcing or restraining strap or gusset system which will enable the aforenoted operational drawbacks characteristic of conventional, prior art bulk material cargo container liner restraint systems to effectively be overcome. More particularly, a need exists in the prior art for a new and improved bulk material cargo container liner, for use in conjunction with bulk material cargo containers, and within which bulk cargo materials are to be accommodated for shipping, transportation, and storage purposes, wherein the reinforcing or restraining strap or gusset system operatively associated therewith is safe to employ, easy to erect, and easy to adjust.

SUMMARY OF THE INVENTION

The foregoing and other objectives are achieved in accordance with the teachings and principles of the present invention through the provision of a new and improved bulk material cargo container liner, for use within a bulk material cargo container, wherein the new and improved bulk material cargo container liner has operatively associated therewith a new and improved strapping or gusset system which effectively forms a bulkhead structure upon the rear end wall member of the bulk material cargo container liner so as to effectively reinforce or restrain the rear end wall member of the bulk material cargo container liner. In this manner, the rear end wall member of the bulk material cargo container liner will experience less rearwardly oriented outward bulging, under the influence of the substantially large hydrostatic head that may be impressed upon the rear end wall member of the bulk material cargo container liner by means of the bulk cargo material which has been charged into or deposited within the bulk material cargo container liner, in view of the fact that the new and improved bulkhead-type strapping or gusset system imparts substantial restraint forces to the rear end wall member of the bulk material cargo container liner when properly erected, connected, and tensioned.

In accordance with a first embodiment of the new and improved external strapping system or arrangement of the present invention, a plurality of horizontally spaced vertically oriented reinforcing or restraining straps and a plurality of vertically spaced horizontally oriented reinforcing or restraining straps are disposed upon the external surface portion of the rear end wall member of the bulk material cargo container liner such that the plurality of horizontally spaced vertically oriented reinforcing or restraining straps and the plurality of vertically spaced horizontally oriented reinforcing or restraining straps crisscross each other in a substantially checkerboard or grid-type pattern. The plurality of vertically oriented reinforcing or restraining straps are, for example, movably disposed upon the rear end wall member of the bulk material car-go container liner as a result of being respectively inserted within and routed through a plurality of horizontally spaced, vertically oriented sleeve members which are affixed upon the external surface portion of the rear end wall member of the bulk material cargo container liner. In addition, vertically spaced regions of the plurality of horizontally spaced, vertically oriented sleeve members are not fixedly secured to the rear end wall member of the bulk material cargo container liner so as to effectively define passageways, between the rear surface portions of the sleeve members and external surface portions of the rear end wall member of the bulk material cargo container liner, through which the plurality of vertically spaced, horizontally oriented restraining or rein-forcing straps are adapted to pass so as to be movable with respect to the plurality of horizontally spaced vertically oriented reinforcing or restraining straps. Alternatively, the sleeves members can be oriented horizontally so as to permit the plurality of vertically spaced, horizontally oriented reinforcing or restraining straps to be movably disposed therein while passageways are defined between the sleeve members and the rear end wall member of the bulk material cargo container liner for accommodating the horizontally spaced vertically oriented reinforcing or restraining straps. In either case, all of the reinforcing straps, both the plurality of horizontally spaced vertically oriented reinforcing or restraining straps, and the plurality of vertically spaced horizontally oriented reinforcing or restraining straps, may be individually tensioned substantially independently of each other.

In accordance with a second embodiment of the new and improved external strapping system or arrangement of the present invention, only a plurality of vertically spaced, horizontally oriented restraining or reinforcing straps are utilized and oppositely disposed free end portions of the individual reinforcing or restraining straps have hoop straps passing therethrough in a doubled-over manner. In this manner, the tension levels within all of the vertically spaced, horizontally oriented reinforcing or restraining straps can be independently adjusted, or they can be adjusted en masse, to relatively high levels as desired or required.

In accordance with a third embodiment of the new and improved reinforcing or restraining system of the present invention, a substantially U-shaped gusset system is fixedly secured upon internal portions of bulk material cargo container liner, more specifically, upon the rear wall member of the cargo container liner as well as upon both of the oppositely disposed side wall members of the bulk material cargo container liner. In addition, heavy-duty belting or strapping affix upper and lower regions of the bulk material cargo container liner to fixed supports provided upon interior portions of the bulk material cargo container. Accordingly, when the bulk cargo material is charged into the bulk material cargo container liner, such belting or strapping, in conjunction with the hydrostatic forces impressed upon the side wall members of the bulk material cargo container liner, effectively fix the side wall members of the bulk material cargo container liner within the bulk material cargo container whereby the side wall members of the bulk material cargo container liner will, in turn, effectively fix and restrain the rear wall member or bulkhead structure of the bulk material cargo container liner within the bulk material cargo container so as to prevent the outward bulging thereof under the influence of the hydrostatic forces impressed thereon by means of the bulk cargo material.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 2:
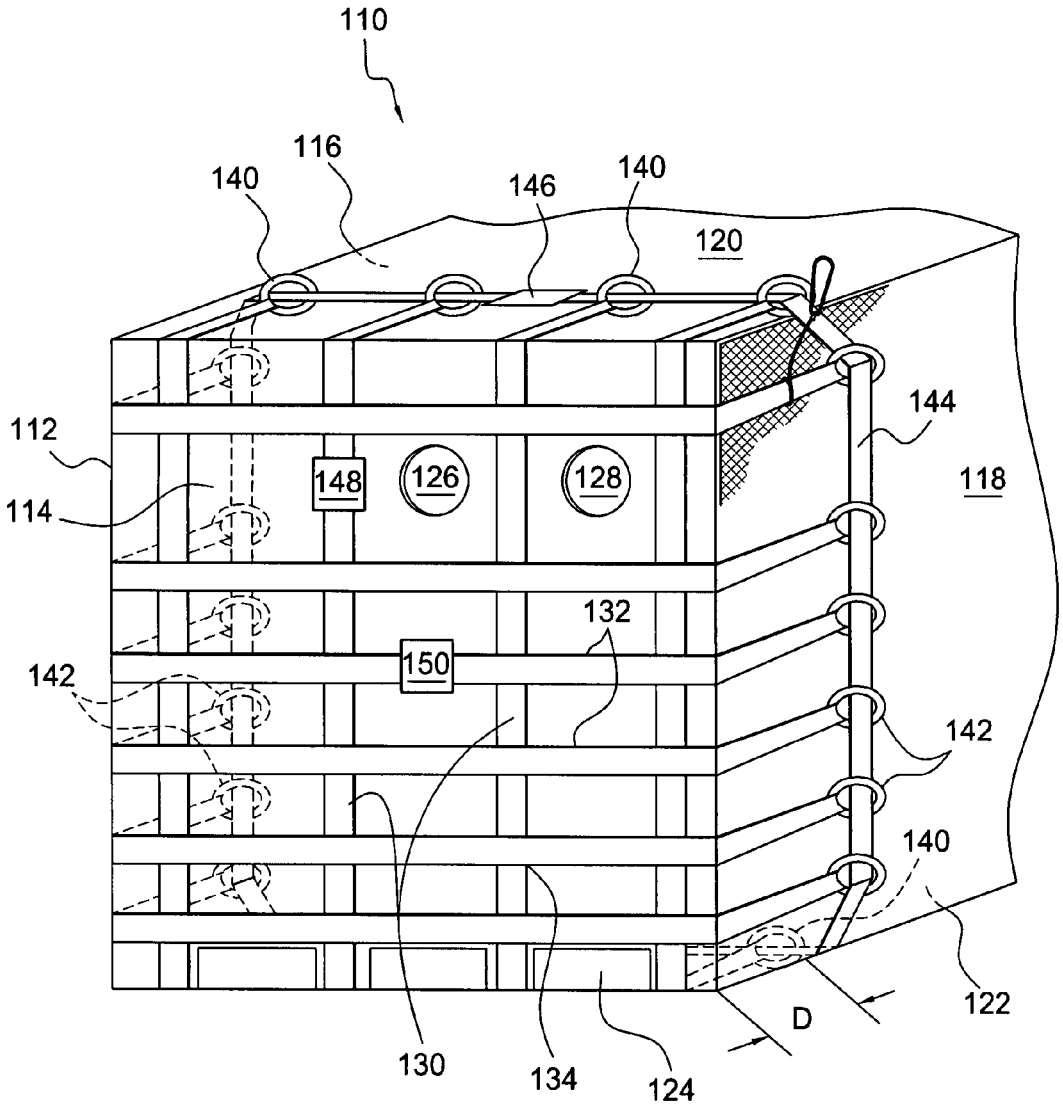
FIG. 2 is a schematic perspective view of a first embodiment of a new and improved reinforcing or restraining strapping system which has been constructed in accordance with the principles and teachings of the present invention in order to effectively comprise a bulkhead structure for operative association with the external surface portion of the rear end wall member of a bulk material cargo container liner so as to provide the rear end wall member of the bulk material cargo container liner with the requisite amount of tension and rigidity in order to resist the hydrostatic head forces which may be impressed thereon by means of the bulk cargo material disposed internally within the bulk material cargo container liner.

Referring now to the drawings, and more particularly to FIG. 2 thereof, a first embodiment of a new and improved reinforcing or restraining strapping system, which has been constructed in accordance with the principles and teachings of the present invention, and is adapted to be operatively associated with the rear end wall member of a bulk material cargo container liner, is disclosed and is generally indicated by the reference character 110. More particularly, the rear section of a bulk material cargo container liner 112 is illustrated within FIG. 2 and is seen to comprise a rear end wall member 114, a left side wall member 116, a right side wall member 118, a top wall member 120, and a bottom wall member 122. In addition, as is conventional, the bulk material cargo container liner 112 is provided with one or more bulk material discharge ports 124 located within the lower region of the rear end wall member 114, and is also provided with a bulk material charging port 126 and a viewing port 128 located within the upper region of the rear end wall member 114. Still further, as will become more apparent hereinafter, the new and improved reinforcing or restraining strap system 110, operatively associated with the rear end wall member 114 of the bulk material cargo container liner 112, has been constructed in accordance with the particular principles and teachings of the present invention so as to effectively comprise a bulkhead structure in order to provide the rear end wall member 114 of the bulk material cargo container liner 112 with the requisite amount of tension and rigidity so as to resist the hydrostatic head forces which may be impressed upon the rear end wall member 114 of the bulk material cargo container liner 112 by means of the bulk cargo material which is disposed internally within the bulk material cargo container liner 112.

More particularly, the first embodiment of a new and improved reinforcing or restraining strapping system 110, which has been constructed in accordance with the principles and teachings of the present invention, is seen to comprise a plurality of horizontally spaced, vertically oriented reinforcing straps 130 which are adapted to be fixedly secured upon the external surface portion of the rear end wall member 114 of the bulk material cargo container liner 112, and a plurality of vertically spaced, horizontally oriented reinforcing straps 132 which are also adapted to be disposed upon the external surface portion of the rear end wall member 114 of the bulk material cargo container liner 112 as a result of effectively crossing over the plurality of horizontally spaced, vertically oriented reinforcing straps 130 at intersection points 134. Accordingly, the plurality of horizontally spaced, vertically oriented reinforcing straps 130 and the plurality of vertically spaced, horizontally oriented reinforcing straps 132 are arranged within a crisscrossed pattern such that the plurality of horizontally spaced, vertically oriented reinforcing straps 130 and the plurality of vertically spaced, horizontally oriented reinforcing straps 132 together define a checkerboard, grid-type, or matrix arrangement. The plurality of reinforcing straps 130, 132 may be fabricated from a suitable material, such as, for example, woven polyester, metal straps, or the like.

Figure 1:
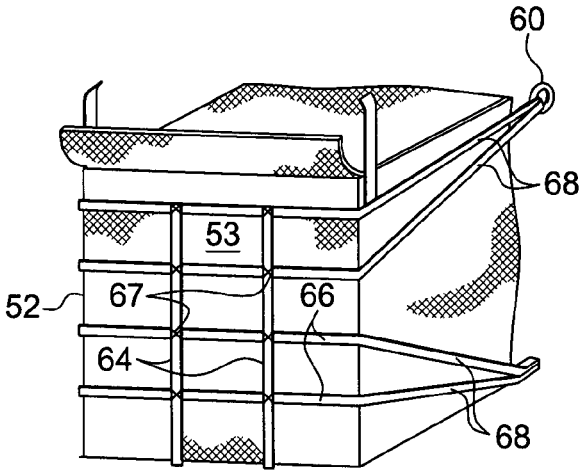
FIG. 1 (PRIOR ART)
FIG. 1 is a perspective view of a conventional, PRIOR ART bulk material cargo container liner having a conventional, PRIOR ART reinforcing strapping system operatively associated with the rear end wall member of the conventional, PRIOR ART bulk material cargo container liner.
Figure 3:
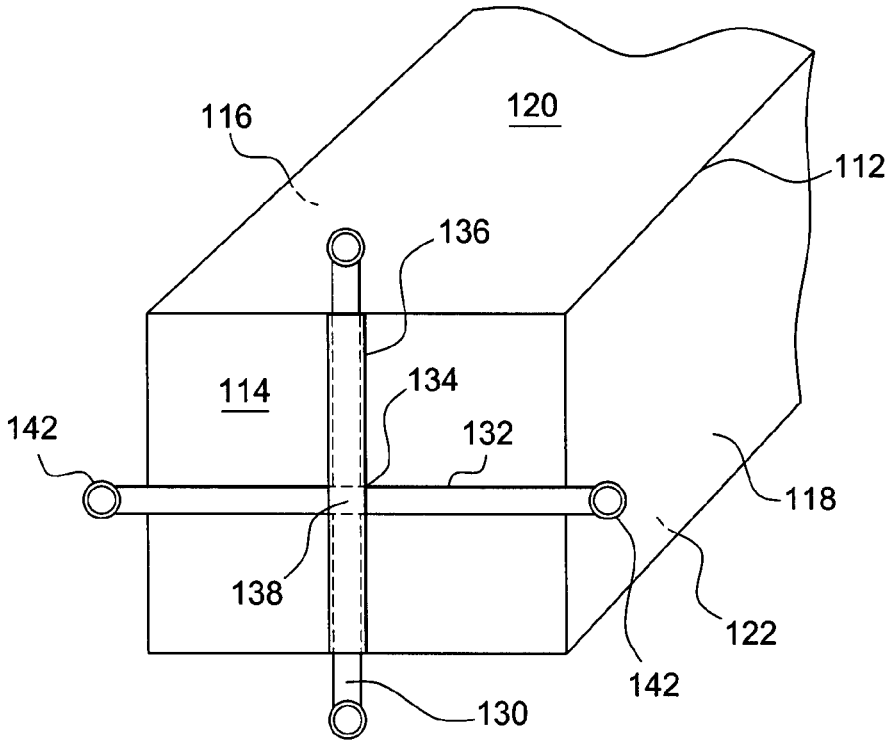
FIG. 3 is a perspective view schematically illustrating, in detail, the fixation of one of the tubular sleeve members, within which one of the plurality of horizontally spaced, vertically oriented reinforcing straps is disposed, upon the rear end wall member of the bulk material cargo container liner so as to accommodate the passage of one of the plurality of vertically spaced, horizontally oriented reinforcing straps behind the tubular sleeve member in order to permit the plurality of horizontally spaced, vertically oriented reinforcing straps and the plurality of vertically spaced, horizontally oriented reinforcing straps to be disposed within the criss-crossed arrangement with the plurality of horizontally spaced, vertically oriented reinforcing straps and the plurality of vertically spaced, horizontally oriented reinforcing straps being freely movable and adjustable with respect to each other.

Continuing further, and in accordance with the unique structure characteristic of the restraining or reinforcing strapping system 110 of the present invention, while the arrangement or array of the plurality of horizontally spaced, vertically oriented reinforcing straps 130 and the plurality of vertically spaced, horizontally oriented reinforcing straps 132 has effectively been shown in a schematic manner within FIG. 2 for clarity purposes, it is more specifically appreciated from FIG. 3, which schematically illustrates one of the intersection points defined between one of the plurality of horizontally spaced, vertically oriented reinforcing straps 130 and one of the plurality of vertically spaced, horizontally oriented reinforcing straps 132, that each one of the plurality of horizontally spaced, vertically oriented reinforcing straps 130 is adapted to be inserted into, and routed through, a tubular sleeve member 136 which is adapted to have its rear surface portion fixedly secured upon the external surface portion of the rear end wall member 114 of the bulk material cargo container liner 112. In addition, selected regions of the tubular sleeve members 136, which will effectively correspond to the locations at which the intersection points 134 between the plurality of horizontally spaced, vertically oriented reinforcing straps 130 and the plurality of vertically spaced, horizontally oriented reinforcing straps 132 are to be formed, will not be fixedly secured upon the external surface portion of the rear end wall member 114 of the bulk material cargo container liner 112. In this manner, accessible openings, spaces, or passageways 138 will effectively be formed between those rear surface portions of the tubular sleeve members 136 which are not fixedly secured upon the external surface portion of the rear end wall member 114 of the bulk material cargo container liner 112 and those portions of the rear end wall member 114 of the bulk material cargo container liner 112 which are located at the intersection points 134. Accordingly, it can be appreciated further that each one of the plurality of vertically spaced, horizontally oriented reinforcing straps 132 is able to be inserted into the opening or space 138 and passed beneath or behind the tubular sleeve member 136 within which one of the plurality of horizontally spaced, vertically oriented reinforcing straps 130 is disposed. It can therefore be appreciated, for a purpose to become more apparent hereinafter, that the plurality of horizontally spaced, vertically oriented reinforcing straps 130 will in effect be freely movable in an independent manner with respect to the plurality of vertically spaced, horizontally oriented reinforcing straps 132, and conversely, the plurality of vertically spaced, horizontally oriented reinforcing straps 132 will, in effect, be freely movable in an independent manner with respect to the plurality of horizontally spaced, vertically oriented reinforcing straps 130.

Continuing still further, it is seen that the free end portions of each one of the plurality of horizontally spaced, vertically oriented reinforcing or restraining straps 130 are adapted to be extended, by means of a predetermined distance D, onto the top and bottom wall members 120,122 of the bulk material cargo container liner 112 and have suitable loop or buckle fasteners 140 attached thereto, and in a similar manner, the free end portions of each one of the plurality of vertically spaced, horizontally oriented reinforcing or restraining straps 132 are adapted to be extended, by means of substantially the same predetermined distance D, onto the left and right side wall members 116, 118 of the bulk material cargo container liner 112 and have suitable loop or buckle fasteners 142 attached thereto. An encircling hoop strap 144, which is only schematically illustrated for clarity purposes, is adapted to be passed through all of the loop or buckle fasteners 140, 142 of the plurality of horizontally spaced, vertically oriented reinforcing or restraining straps 130 and the plurality of vertically spaced, horizontally oriented reinforcing or restraining straps 132.

The hoop strap 144 is adapted to be fixedly connected to one or more fixtures or anchors, not shown, which are fixedly secured at various interior locations or positions of the bulk material cargo container, and the hoop strap 144 is also adapted to be properly tensioned by means of a suitable tension adjustment mechanism schematically illustrated at 146. In addition, each one of the plurality of horizontally spaced, vertically oriented restraining or reinforcing straps 130 and each one of the plurality of vertically spaced, horizontally oriented reinforcing or restraining straps 132 is also provided with a suitable tension adjustment mechanism schematically illustrated at 148 and 150, respectively.

Therefore, it can be readily appreciated that, in accordance with the principles and teachings of the present invention, each one of the plurality of horizontally spaced, vertically oriented reinforcing or restraining straps 130 and each one of the plurality of vertically spaced, horizontally oriented reinforcing or restraining straps 132 may be individually tensioned to a predetermined or desired tension level in an independent manner with respect to any other one of the plurality of horizontally spaced, vertically oriented reinforcing or restraining straps 130 or any other one of the plurality of vertically spaced, horizontally oriented reinforcing or restraining straps 132. This is of course able to be achieved in view of the aforenoted intersecting structure, defined between the plurality of horizontally spaced, vertically oriented restraining or reinforcing straps 130 and the plurality of vertically spaced, horizontally oriented reinforcing or restraining straps 132 by means of the tubular sleeve members 136 and the spaces or recesses 138 behind the same, which permit the plurality of horizontally spaced, vertically oriented reinforcing or restraining straps 130 and the plurality of vertically spaced, horizontally oriented reinforcing or restraining straps 132 to be freely movable with respect to each other.

Accordingly, the tension levels within any region of the bulkhead structure, effectively formed by means of the criss-crossed checkerboard, grid, or matrix-type arrangement of the plurality of horizontally spaced, vertically oriented reinforcing or re-straining straps 130 and the plurality of vertically spaced, horizontally oriented reinforcing or restraining straps 132 can be adjusted as is necessary or desirable. It is of course to be further appreciated that a reverse type system can also be implemented, that is, wherein the tubular sleeve members 136 are respectively fixedly secured upon the plurality of vertically spaced, horizontally oriented reinforcing or re-straining straps 132 so as to effectively define vertically oriented passageways therethrough in order to respectively permit the plurality of horizontally spaced, vertically oriented restraining or reinforcing straps 130 to pass therethrough at the intersection points or locations 134.

Figure 4:
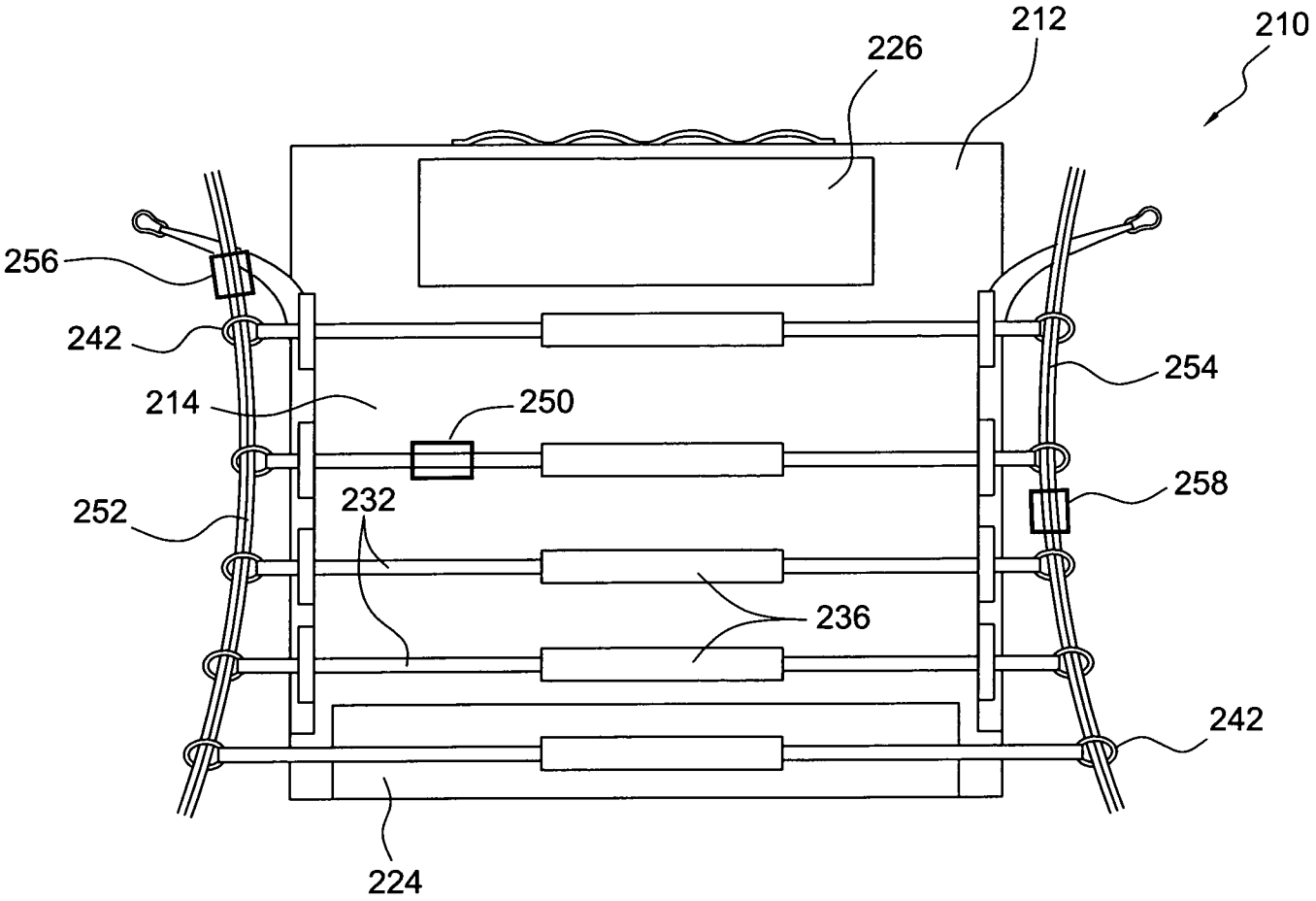
FIG. 4 is a schematic elevational view showing a second embodiment of a new and improved restraining or reinforcing strapping system that has also been constructed in accordance with the principles and teachings of the present invention in order to effectively comprise a bulkhead structure for operative association with the external surface portion of the rear end wall member of a bulk material cargo container liner so as to provide the rear end wall member of the bulk material cargo container liner with the requisite amount of tension and rigidity in order to resist the hydrostatic head forces which may be impressed thereon by means of the bulk cargo material disposed internally within the bulk material cargo container liner.

With reference now being made to FIG. 4, a second embodiment of a new and improved restraining or reinforcing strapping system, which has also been constructed in accordance with the principles and teachings of the present invention, and is likewise adapted to be operatively associated with the rear end wall member of a bulk material cargo container liner, is disclosed and is generally indicated by the reference character 210. It is noted that this second embodiment reinforcing or restraining strapping system 210 is somewhat similar to the first embodiment restraining or reinforcing strapping system 110, except as will be noted specifically, and therefore, a detailed description of the same will be omitted herefrom for brevity purposes. It is also noted that component parts of the second embodiment restraining or reinforcing strapping system 210 which correspond to similar component parts of the first embodiment reinforcing or restraining strapping system 110 will be noted by means of similar reference characters except that they will be within the 200 series. More particularly, it is seen that several differences exist between the second embodiment restraining or reinforcing strapping system 210 and the first embodiment reinforcing or restraining strapping system 110. For example, it is seen that the second embodiment reinforcing or restraining strapping system 210 does not include any horizontally spaced, vertically oriented reinforcing or restrainging straps, but only comprises a plurality of vertically spaced, horizontally oriented reinforcing or restraining straps 232. In addition, it is seen that, in a manner similar to the utilization of the tubular sleeve members 136 in connection with the horizontally spaced, vertically oriented reinforcing or restraining straps 130 as illustrated within FIGS. 2 and 3, a plurality of vertically spaced, horizontally oriented tubular sleeve members 236 are fixedly mounted upon the external surface portion of the rear end wall member 214 of the bulk material cargo container liner 212, and that the plurality of vertically spaced, horizontally oriented reinforcing or restraining straps 232 are adapted to be respectively passed through the plurality of tubular sleeve members 236. In addition, the oppositely disposed free end portions of each one of the plurality of vertically spaced, horizontally oriented reinforcing or restraining straps 232 is provided with loop or buckle fastener structure 242, which may be similar to those illustrated at 142 in connection with the plurality of vertically spaced, horizontally oriented reinforcing or restraining straps 132, and a pair of hoop straps 252, 254 are adapted to be passed through the fastener structures 242.

In particular, however, it is further noted that the hoop straps 252,254 do not comprise single pass hoop straps as was the case with the hoop strap 144 of the first embodiment system 110 as illustrated within FIG. 2. More specifically, in lieu of the single pass hoop strap arrangement illustrated within FIG. 2 in connection with the first embodiment reinforcing or restraining strapping system 110, wherein, for example, the hoop strap 144 comprises one pass of the hoop strap 144 internally within each one of the fastener structures 142 operatively associated with the free end portions of the plurality of vertically spaced, horizontally oriented reinforcing or restraining straps 132, in accordance with the hoop strap arrangement characteristic of the second embodiment restraining or reinforcing strapping system 210, the hoop straps 252,254 are adapted to effectively be looped upon themselves so as to have dual passes thereof disposed internally within the fastener structures 242 operatively associated with the free end portions of the plurality of vertically spaced, horizontally oriented reinforcing or restraining straps 232.

More particularly, for example, a first pass of each one of the hoop straps 252, 254 is respectively first passed through all of the fastener structures 242 operatively associated with the free end portions of the plurality of vertically spaced, horizontally oriented reinforcing or restraining straps 232 disposed upon the particular right or left side of the bulk material cargo container liner 212, the particular hoop strap 252, 254 is then routed around, for example, a support fixture or anchor, not shown, fixedly mounted upon a lower internal portion of the bulk material cargo container, then passed back through each one of the fastener structures 242 operatively associated with the free end portions of the plurality of vertically spaced, horizontally oriented reinforcing or restraining straps 232, and ultimately routed around a support fixture or anchor, also not shown, fixedly mounted upon an upper internal portion of the bulk material cargo container and appropriately fixed or secured. It is also noted that the hoop straps 252, 254 are respectively provided with suitable tensioning mechanisms 256, 258 similar to the tensioning mechanism 146 for the hoop strap 144. It can therefore be appreciated that in accordance with the teachings and principles of this second embodiment restraining or reinforcing strapping system 210, each one of the vertically spaced, horizontally oriented restraining or reinforcing straps 232 can be individually adjusted or tensioned as may be desired or required in order to impart predetermined levels of tension to predetermined regions of the rear wall member or bulkhead structure 214 of the bulk material cargo container liner 212.

Figure 5:
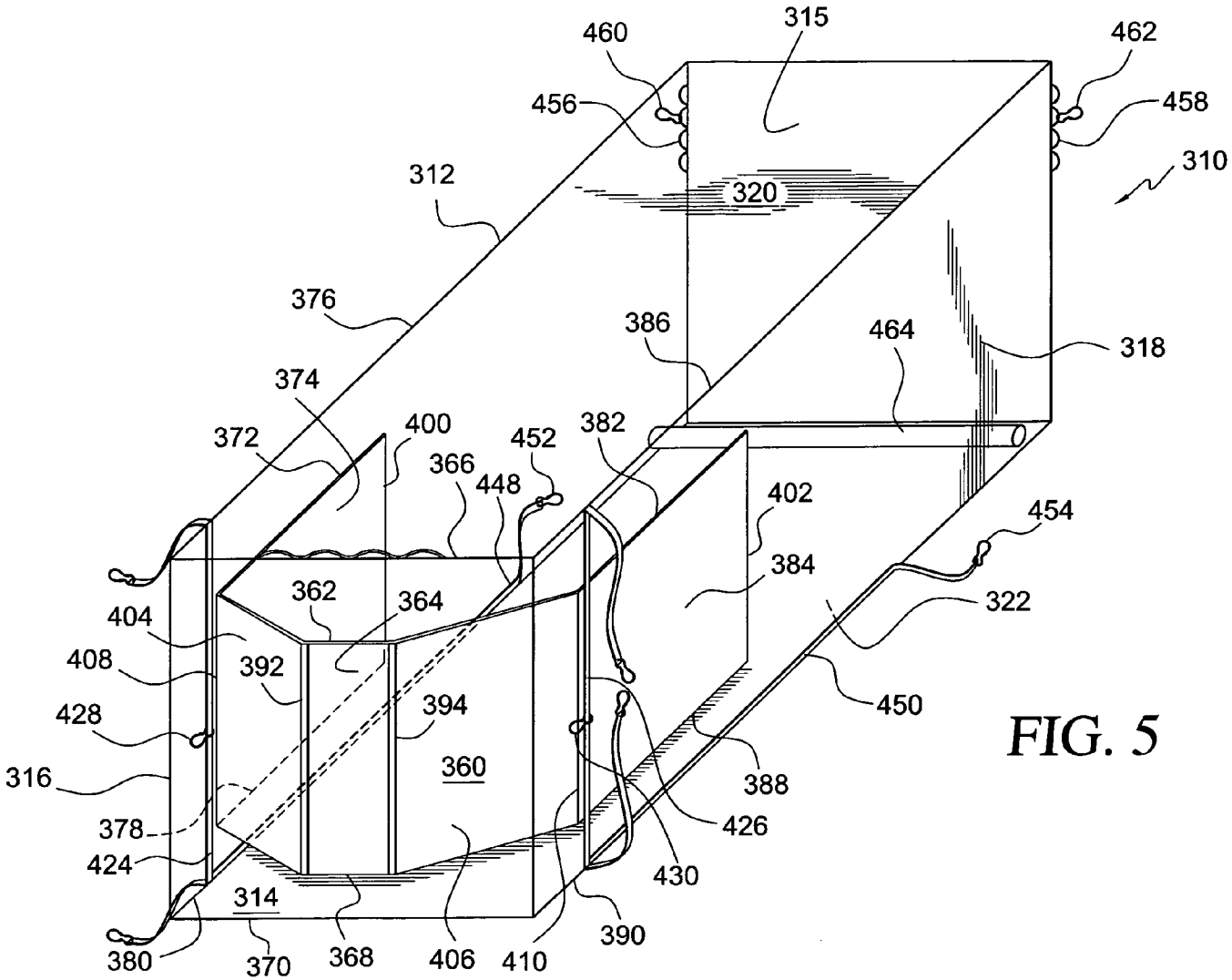
FIG. 5 is a perspective view, similar to that of FIG. 2, showing, however, a third embodiment of a new and improved restraining or reinforcing system that has been constructed in accordance with the principles and teachings of the present invention, wherein the third embodiment comprises the use of a substantially U-shaped gusset system fixedly secured to interior rear and side wall portions of the bulk material cargo container liner in order to effectively restrain or reinforce the rear wall member of the bulk material cargo container liner from experiencing or undergoing outward bulging as a result of the hydrostatic head forces impressed thereon by means of the bulk cargo material present within the bulk material cargo container liner.
Figure 6:
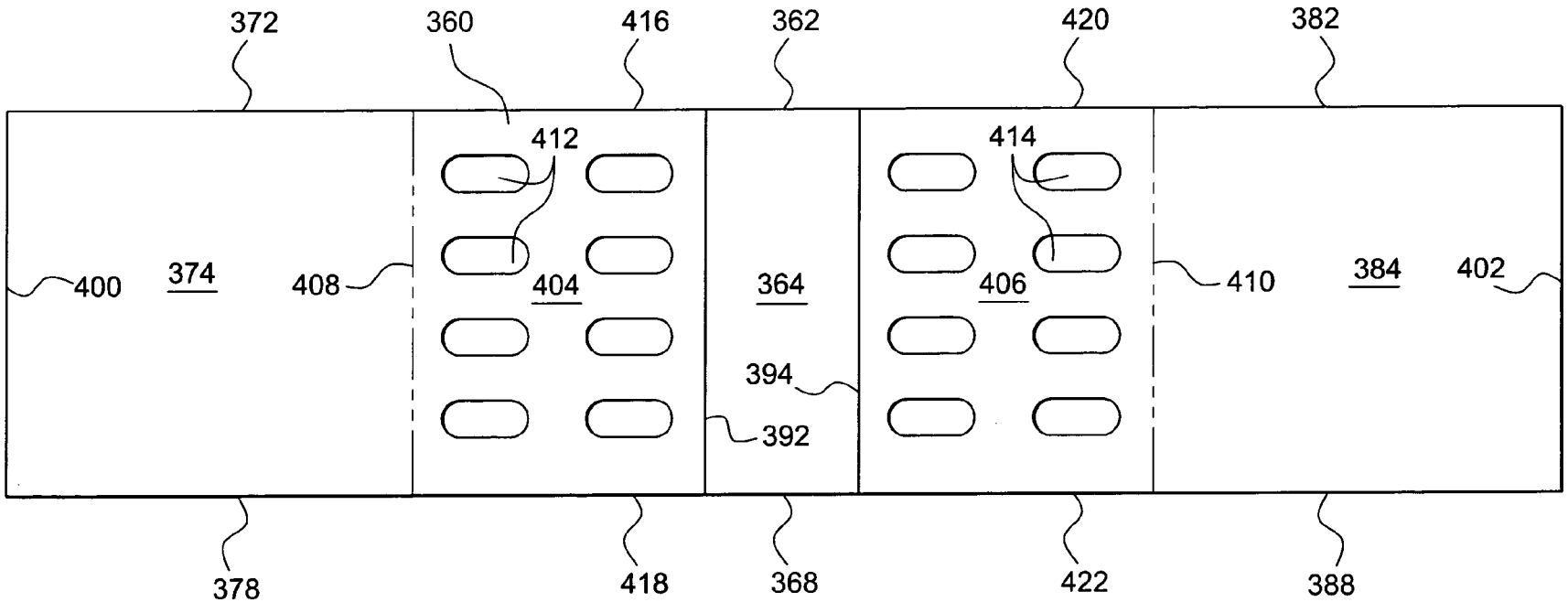
FIG. 6 is an elevational view of the substantially U-shaped gusset member utilized within the third embodiment reinforcing or restraining system as disclosed within FIG. 5 wherein the U-shaped gusset member is disclosed in a substantially planar state prior to its fixation upon the internal rear and side wall member portions of the bulk material cargo container liner.
Figure 7:
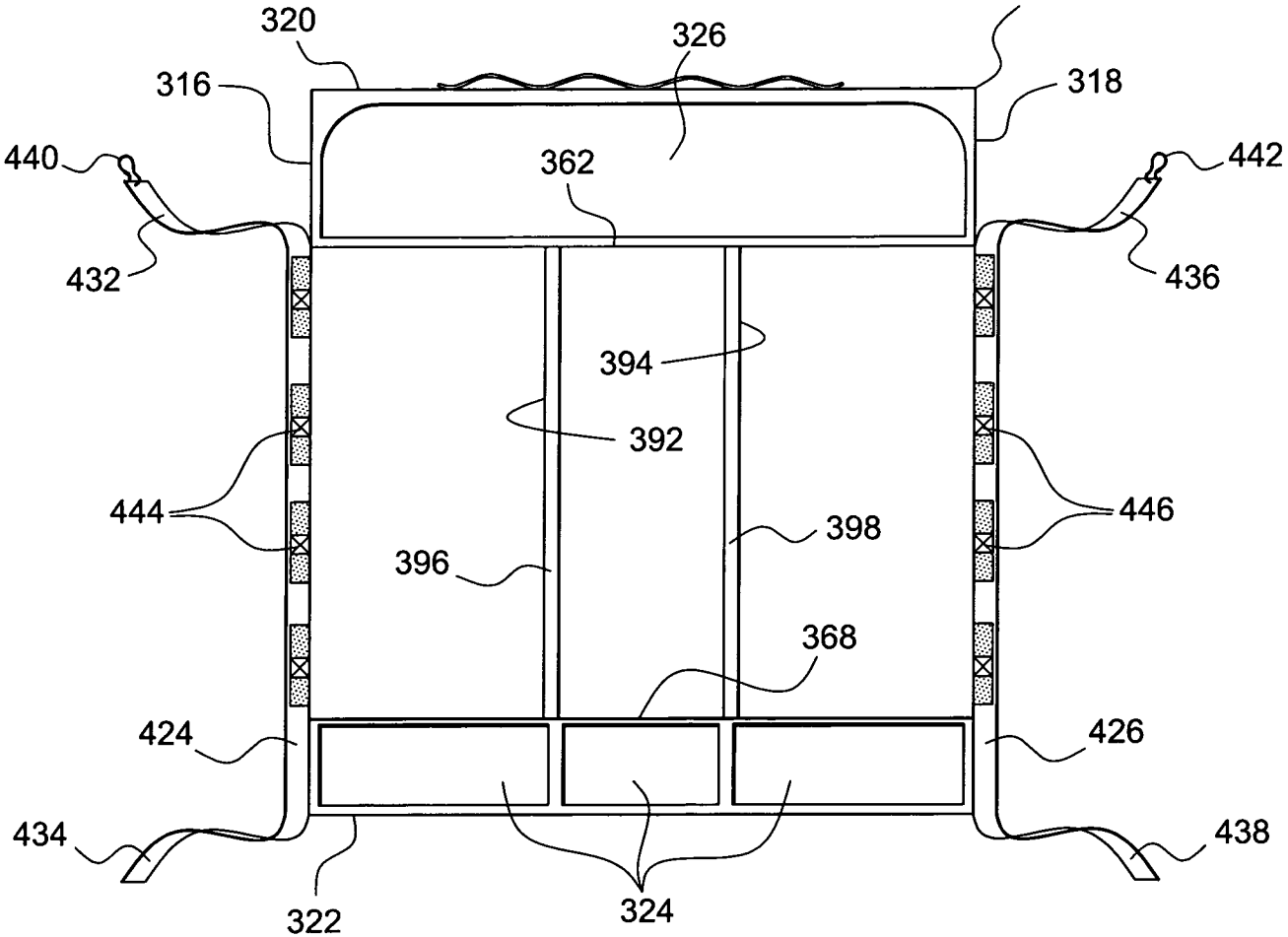
FIG. 7 is an elevational view, similar to that of FIG. 4, showing however, a bulk material cargo container liner having the third embodiment gusset restraining or reinforcing system fixedly mounted thereon so as to provide the rear end wall member of the bulk material cargo container liner with the requisite amount of tension and rigidity in order to resist the hydrostatic head forces which may be impressed thereon by means of the bulk cargo material disposed internally within the bulk material cargo container liner.

With reference now being made to FIGS. 5-7, a third embodiment of a new and improved restraining or reinforcing system, which has been constructed in accordance with the principles and teachings of the present invention, and is adapted to be operatively associated with the rear end wall member of a bulk material cargo container liner, is disclosed and is generally indicated by the reference character 310. As was the case with the second embodiment restraining or reinforcing system 210 with respect to the first embodiment reinforcing or restraining system 110, this third embodiment restraining or reinforcing system 310 is conceptually similar to the first and second embodiment restraining or reinforcing systems 110,210, except as will be noted specifically, and therefore, a detailed description of the same will be omitted herefrom for brevity purposes. It is also noted that component parts of the third embodiment restraining or reinforcing system 310 which correspond to similar component parts of the first and second embodiment reinforcing or restraining systems 110,210 will be noted by means of similar reference characters except that they will be within the 300 and 400 series. More particularly, it is initially noted that the primary difference between the third embodiment restraining or reinforcing system 310, as compared to the first and second embodiment restraining or reinforcing systems 110,210 resides in the fact that in lieu of the plurality of horizontally spaced, vertically oriented reinforcing or restraining straps 130, and similarly, in lieu of the plurality of vertically spaced, horizontally oriented reinforcing or restraining straps 132, 232, the third embodiment restraining or reinforcing system 310 comprises the use of a planar, one-piece gusset member 360 having a substantially rectangular configuration, as disclosed within FIG. 6, which, when actually utilized in conjunction with, and attached to, the bulk material cargo container liner 312, as will be discussed shortly hereinafter, has a substantially U-shaped cross-sectional configuration as can best be seen in FIG. 5.

In a manner similar to that characteristic of the previously noted bulk material cargo container liners 112, 212, the bulk material cargo container liner 312, in conjunction with which the new and improved third embodiment reinforcing or restraining system 310 of the present invention is to be used, has a geometrical configuration substantially comprising that of a parallelepiped and is therefore seen to comprise a rear end wall member 314, a front wall member 315, a left side wall member 316, a right side wall member 318, a top wall member 320, and a bottom wall member 322. The bulk material cargo container liner 312 may be fabricated from a suitable material, such as, for example, woven polypropylene, woven polyethylene, or a lamination comprising woven polypropylene and woven polyethylene, and similarly for the substantially U-shaped reinforcing or restraining gusset member 360. The overall longitudinal extent or length dimension of the bulk material cargo container liner 312 is approximately two hundred fifteen inches (215.00"), the lateral extent or width dimension of the bulk material cargo container liner 312 is approximately ninety-two and one-half inches (92.50"), and the vertical extent or height dimension of the bulk material cargo container liner 312 is approximately ninety-three inches (93.00"). To the contrary, however, it is noted that the overall longitudinal extent or length dimension of the reinforcing or restraining gusset member 360 is approximately two hundred thirty and one-half inches (230.50") while the vertical extent or height dimension of the restraining or reinforcing gusset member 360 is approximately fifty-eight inches (58.00").

Accordingly, as can best be appreciated from FIG. 5, when the reinforcing or restraining gusset member 360 is fixedly mounted upon the interior surface portions of the bulk material cargo container liner 312, in a manner that will be described more fully shortly hereinafter, the reinforcing or restraining gusset member 360 will effectively be substantially vertically centered upon the bulk material cargo container liner 312. More particularly, for example, the upper edge portion 362 of the center section 364 of the reinforcing or restraining gusset member 360 will be spaced a predetermined distance, from the intersection or interface 366 defined between the rear wall member 314 and the top wall member 320 of the bulk material cargo container liner 312, which will be substantially equal to the distance defined between the lower edge portion 368 of the center section 364 of the reinforcing or restraining gusset member 360 and the intersection or interface 370 formed between the rear wall member 314 and the bottom wall member 322.

In a similar manner, it is likewise seen that the upper edge portion 372 of the left side section 374 of the reinforcing or restraining gusset member 360 will be spaced a predetermined distance, from the intersection or interface 376 defined between the left side wall member 316 and the top wall member 320 of the bulk material cargo container liner 312, which will be substantially equal to the distance defined between the lower edge portion 378 of the left side section 374 of the reinforcing or restraining gusset member 360 and the intersection or interface 380 formed between the left side wall member 316 and the bottom wall member 322. In a still similar manner, it is likewise seen that the upper edge portion 382 of the right side section 384 of the reinforcing or restraining gusset member 360 will be spaced a predetermined distance, from the intersection or interface 386 defined between the right side wall member 318 and the top wall member 320 of the bulk material cargo container liner 312, which will be substantially equal to the distance defined between the lower edge portion 388 of the right side section 384 of the reinforcing or restraining gusset member 360 and the intersection or interface 390 formed between the right side wall member 318 and the bottom wall member 322.

With reference still being made to FIGS. 5-7, it is further seen that the center section 364 of the reinforcing or restraining gusset member 360 has a substantially rectangular configuration and is therefore further defined by means of a left vertical edge portion 392 and a right vertical edge portion 394. In addition, it is to be noted that when the reinforcing or restraining gusset member 360 is to be fixedly attached to the bulk material cargo container liner 312, all of the peripheral edge portions 362, 368, 392, 394 of the center section 364 of the reinforcing or restraining gusset member 360 will be sewn or stitched to the inner surface portion of the rear wall or bulkhead member 314 of the bulk material cargo container liner 312.

Furthermore, in order to effectively reinforce the stitched or sewn attachment of the center section 364 of the reinforcing or restraining gusset member 360 to the inner surface portion of the rear wall or bulkhead member 314 of the bulk material cargo container liner 312, a pair of heavy duty reinforcing belts 396, 398, coextensive with the sewn or stitched fixation of the left and right vertical edge porions 392,394 of the reinforcing or restraining gusset member 360 to the inner surface portion of the rear wall or bulkhead member 314 of the bulk material cargo container liner 312, are fixedly secured, for example, by sewing or stitching, to the external surface portion of the rear wall or bulkhead member 314 of the bulk material cargo container liner 312. Accordingly, a pair of three-layer, vertically oriented laminated regions are effectively formed at the vertical fixation locations of the restraining or reinforcing gusset member 360 upon the rear wall or bulkhead member 314 of the bulk material cargo container liner 312, that is, the laminated regions comprise the left and right vertical side edge portions 392,394 of the restraining or reinforcing gusset member 360 disposed upon the internal surface portion of the rear wall or bulkhead member 314 of the bulk material cargo container liner 312, the rear wall or bulkhead member 314 per se of the bulk material cargo container liner 312, and the vertically oriented reinforcing belts 396, 398 disposed upon the external surface portion of the rear wall or bulkhead member 314 of the bulk material cargo container liner 312.

Continuing further, it is also seen that when the substantially U-shaped reinforcing or restraining gusset member 360 is fixedly secured to the various inner surface portions of the bulk material cargo container liner 312, as can best be appreciated from FIG. 5, it is seen that the oppositely disposed vertically oriented left and right side edge portions 400,402 of the reinforcing or restraining gusset member 360 will be disposed toward the front wall member 315 of the bulk material cargo container liner 312 and that the left and right side sections 374, 384 of the reinforcing or restraining gusset member 360 will extend approximately one-half the longitudinal extent of the bulk material cargo container liner 312. In connection with the respective actual fixation of the left and right side sections 374, 384 of the reinforcing or restraining gusset member 360 upon the left and right side wall members 316,318 of the bulk material cargo container liner 312, it is initially noted that a pair of left and right side intermediate sections 404,406 of the reinforcing or restraining gusset member 360 are effectively defined between the center section 364 of the reinforcing or restraining gusset member 360 and the left and right side sections 374,384 of the reinforcing or restraining gusset member 360, as can best be seen in FIG. 6, wherein the left intermediate section 404 extends between the left vertical edge portion 392 of the center section 364 and a left vertically oriented virtual edge portion 408, while the right intermediate section 406 extends between the right vertical edge portion 394 of the center section 364 and a right vertically oriented virtual edge portion 410.

As can best be appreciated from FIG. 5, it is also seen that the left and right intermediate sections 404, 406 of the gusset member 360 are respectively disposed at predetermined angled orientations with respect to the center section 364 of the restraining or reinforcing gusset member 360 and the rear wall or bulkhead member 314 of the bulk material cargo container liner 312, as well as with respect to the left and right side sections 374, 384 of the reinforcing or restraining gusset member 360 and the left and right side wall members 316, 318 of the bulk material cargo container liner 312, so as to effectively traverse and be disposed toward, the rear corner regions of the bulk material cargo container liner. In addition, it is also seen that each one of the left and right intermediate sections 404, 406 of the gusset member 360 has a plurality of apertures 412, 414 defined therein for permitting incoming bulk cargo material to pass therethrough and thereby effectively fill the rear corner regions of the bulk material cargo container liner 312. Still yet further, it is also to be appreciated that each one of the forwardly disposed regions of the angled intermediate sections 404, 406 of the gusset member 360 respectively contacts the left and right side wall members 316, 318 of the bulk material cargo container liner 312 along the vertical loci defined by means of the left and right vertically oriented virtual edge portions 408, 410. In addition, it is noted that the upper and lower edge portions 416, 418 of the left intermediate section 404 are not fixed to the internal surface portion of the bulk material cargo container liner 312, and similarly for the upper and lower edge portions 420, 422 of the right intermediate section 406. Conversely, however, it is noted that the upper, lower, and left side edge portions 372, 378, 400 of the left side section 374 of the gusset member 360 are all fixedly attached to internal surface portions of the left side wall member 316 of the bulk material cargo container liner 312, such as, for example, by means of suitable sewing or stitching, while in a similar manner, the upper, lower, and right side edge portions 382, 388, 402 of the right side section 384 of the gusset member 360 are all fixedly attached to internal surface portions of the right side wall member 318 of the bulk material cargo container liner 312 by means of, for example, suitable sewing or stitching. Accordingly, it can be further appreciated that the left and right vertically oriented virtual edge portions 408, 410 of the reinforcing or restraining gusset member 360, respectively defined between the left intermediate and left side sections 404, 374, and between the right intermediate and right side sections 406, 384, are not in fact fixedly secured to the internal surface portions of the bulk material cargo container liner 312.

Continuing still further, it can also be appreciated that as a result of the aforenoted fixation of the reinforcing or restraining gusset member 360 to the internal portions of the bulk material cargo container liner 312 in the specific manner that has been described and illustrated, then as the bulk cargo material is continuously charged into the bulk material cargo container liner 312 through means of, for example, the bulk cargo material inlet port 326 as best seen in FIG. 7, the outwardly oriented hydrostatic forces generated by means of the bulk cargo material, and acting against, for example, the front wall member 315, and the left and right side wall members 316, 318, of the bulk material cargo container liner 312 will effectively force the front wall member 315 and the left and right side wall members 316, 318 of the bulk material cargo container liner 312 into engagement with the respective internal wall surface portions of the front and left and right side wall members of the bulk material cargo container with substantial or relatively large force factors.

In this manner, the front wall member 315 and the left and right side wall members 316, 318 of the bulk material cargo container liner 312 will effectively be positionally fixed at predetermined positions within the bulk material cargo container so as to, in turn, in effect, positionally fix the entire bulk material cargo container liner 312 at a predetermined position within the bulk material cargo container. Accordingly still further, as a result of such forced engagement and fixation of the front wall member 315 and the left and right side wall members 316, 318 of the bulk material cargo container liner 312 upon the front and left and right side wall members of the bulk material cargo container, and as a result of the aforenoted respective fixation of the left and right side sections 374, 384 of the restraining or reinforcing gusset member 360 upon the left and right side wall members 316,318 of the bulk material cargo container liner 312, and still further, as a result of the aforenoted one-piece or integral construction of the restraining or reinforcing gusset member 360 comprising the center section 364, the left and right intermediate sections 404, 406, and the left and right side sections 374, 384, wherein the center section 364 of the gusset member 360 is structurally connected to the left and right side sections 374, 384 of the gusset member 360, as well as being structurally fixed to or upon the internal surface portion of the rear wall member 314 of the bulk material cargo container liner 312, the hydrostatic forces tending to act outwardly upon the rear wall member 314 of the bulk material cargo container liner 312 will effectively be restrained by means of the substantially U-shaped reinforcing or restraining gusset member 360 so as to effectively prevent the outward bulging of the rear wall member 314 of the bulk material cargo container liner 312.

More particularly, or considered from a somewhat opposite perspective or point of view, not only will the bulk cargo material hydrostatic head forces, acting upon the center section 364 of the reinforcing or restraining gusset member 360 and the rear wall member 314 of the bulk material cargo container liner 312, effectively be transmitted to the left and right side sections 374, 384 of the gusset member 360 through means of the aforenoted integral or one-piece structure comprising the gusset member 360, but in addition, such hydrostatic head forces will, in turn, be respectively transmitted to the left and right side wall members 316, 318 of the bulk material cargo container liner 312 along the upper, lower, and forward edge portions 372, 378, 400, and 382, 388, 402, of the left and right side sections 374, 384 of the gusset member 360 which are sewn or stitched to the left and right side wall members 316,318 of the bulk material cargo container liner 312. It is to be further appreciated that as a result of the left and right vertically oriented virtual edge portions 408,410 of the reinforcing or restraining gusset member 360, respectively defined between the left intermediate and left side sections 404, 374, and between the right intermediate and right side sections 406, 384, not in fact being fixedly secured to the internal surface portions of the bulk material cargo container liner 312 by means of, for example, sewing or stitching, the aforenoted forces are in fact able to be transmitted from the center section 364 of the gusset member 360 and the rear wall member 314 of the bulk material cargo container liner 312 to the left and right side sections 374, 384 of the gusset member 360 and to the side wall members 316, 318 of the bulk material cargo container liner 312 because the absence of the sewing or stitching along the left and right vertically oriented virtual edge portions 408, 410 of the reinforcing or restraining gusset member 360 does not cut off or terminate such force transmissions or propagations.

In addition, when the bulk cargo material disposed within the bulk material cargo container liner 312 is to emptied or discharged from the bulk material cargo container liner 312 through means of one or more discharge ports 324, as best seen in FIG. 7, wherein the bulk material cargo container will be tilted such that the forward end section of the bulk material cargo container will, at some point in time, be elevated relative to the rear end section of the bulk material cargo container, if the gusset member 360 was fixedly attached to the internal surface portions of the bulk material cargo container liner 312 along the left and right vertically oriented virtual edge portions 408, 410, then a substantially large proportion of the gravitational forces would effectively be concentrated upon the sewn or stitched regions corresponding to the left and right vertically oriented virtual edge portions 408, 410. This would not only be detrimental to the structural integrity of the bulk material cargo container liner 312 in that the regions of the bulk material cargo container liner 312, within the vicinity of the aforenoted left and right vertically oriented virtual edge portions 408, 410, would probably rupture or fail due to such high concentration of gravitational forces, but in addition, the gravitational forces would not be able to effectively be transmitted to the left and right side forwardly disposed sections 374, 384 of the reinforcing or restraining gusset member 360 in order to in fact adequate reinforce, restrain, and support the rear wall member 314 of the bulk material cargo container liner 312 through means of the interconnected center section 364 of the reinforcing or restraining gusset member 360.

It is lastly noted in connection with the fixation of the bulk material cargo container liner 312 within the bulk material cargo container, that a plurality of different external straps, belts, ropes, or the like, are utilized to connect various regions of the bulk material cargo container liner 312 to fixed internal locations of the bulk material cargo container liner. For example, a pair of vertically oriented heavy duty straps or belts 424, 426, as can best be seen in FIGS. 5 and 7, are fixedly secured to external surface portions of the left and right side wall members 316,318 of the bulk material cargo container liner 312, within the vicinity of the rear wall member 314 of the bulk material cargo container liner 312, by means of suitable sewing, stitching, or the like. Hook fasteners 428, 430 may be fixedly secured to the belts or straps 424, 426 so as to, in turn, be connected to fixtures secured upon internal wall portions of the bulk material cargo container, and in a similar manner, one of the loose or free end portions 432, 434 and 436, 438 of the belts or straps 424, 426, as may best be seen in FIG. 7, may also be provided with additional hook fastener hardware 440, 442 so as to tension or secure the loose or free end portions 432, 434 and 436, 438 together. In addition, a plurality of vertically spaced VELCRO® fasteners 444, 446 are effectively affixed to or embedded within the belts or straps 424, 426 so as to effectively provided fastener locations at which, for example, additional horizontally oriented reinforcing or restraining straps or belts, similar to the reinforcing or restraining straps 132, 232 illustrated within FIGS. 2 and 4, may be removably secured to the vertically oriented belts or straps 424, 426.

Continuing further, heavy duty horizontally oriented belts or straps 448, 450 are also affixed to external portions of the bulk material cargo container liner 312 so as to extend longitudinally, from the rearward corner portions of the bulk material cargo container liner 312 toward the forward corner portions of the bulk material cargo container liner 312 along the lower intersections or interfaces respectively defined between the left side wall member 316 and the bottom wall member 322 of the bulk material cargo container liner 312, and between the right side wall member 318 and the bottom wall member 322 of the bulk material cargo container liner 312. As was the case with the vertically oriented belts or straps 424, 426, the free end portions of the belts or straps 448, 450 are respectively provided with hook type fasteners 452, 454 for connection to fixtures mounted upon internal portions of the bulk material cargo container.

Still yet further, a plurality of vertically oriented fastener loop arrays 456, 458 are affixed to upper front corner regions of the bulk material cargo container liner 312 as respectively defined between the left side wall member 316 and the front wall member 315 of the bulk material cargo container liner 312, and between the right side wall member 318 and the front wall member 315 of the bulk material cargo container liner 312. In addition, hook type fasteners 460, 462 may be connected to any one of the plurality of fastener loops 456, 458 depending upon the particular elevational locations of the fixtures defined upon the internal wall portions of the bulk material cargo container. Lastly, a transversely oriented sleeve member 464 is fixedly secured beneath the forward end portion of the bottom wall member 322 of the bulk material cargo container liner 312 at a position within the vicinity of the front end wall member 315. A securing strap or belt, not shown, is adapted to be inserted within and passed through the sleeve member 464 such that free end portions of the securing belt or strap can be affixed to fixtures defined upon internal wall portions of the bulk material cargo container in order to fix or secure the forward end portion of the bulk material cargo container liner 312 within the bulk material cargo container, particularly when the bulk material cargo container undergoes the aforenoted upward tilting thereof in connection with the emptying or discharge of the bulk cargo material from the bulk material cargo container liner 312.

Thus, it may be seen that in accordance with the principles and teachings of the present invention, there has been provided a new and improved bulk material cargo container liner which comprises a new and improved external reinforcing or restraining strap system which will permit selected ones of the various horizontally spaced, vertically oriented reinforcing or restraining straps, or selected ones of the vertically spaced, horizontally oriented reinforcing or restraining straps, to have their tension levels individually adjusted in a manner which is substantially independent of each other in order to provide selected sections of the external reinforcing or restraining strapping system with the requisite amount of tension. In addition, a substantially U-shaped reinforcing or restraining gusset system is also disclosed which provides the necessary reinforcement or restraint for the rear wall member or bulkhead of the bulk material cargo container liner but with a simplified structure which effectively eliminates the aforenoted strapping system.

Obviously, many variations and modifications of the present invention are possible in light of the above teachings. For example, while the rear end wall member of the bulk material cargo container liner has been effectively noted as being a single layer component, it may comprise a multi-layer or laminate type structure in which case the reinforcing or restraining strapping system of the present invention would effectively be mounted or secured upon the outermost layer of the multi-layer or laminate type structure. Still further, while it has been noted that one of the horizontally spaced, vertically oriented reinforcing or restraining straps is disposed within its respective tubular sleeve member, more than one vertically oriented reinforcing or restraining strap may be disposed within the tubular sleeve member, and still further, different reinforcing or restraining straps, having different size or thickness dimensions, may also be utilized. Still yet further, similar comments hold true for the hoop straps, that is, there can be more than one hoop strap used together and they can vary in size or thickness dimensions, or the like. It is therefore to be understood that within the scope of the appended claims, the present invention may be practiced otherwise than as specifically described herein.

What is claimed as new and desired to be secured by Letters Patent of the United States of America is:

1. A reinforcing strapping system for use in connection with the rear end wall member of a bulk material cargo container liner in order to prevent the out-ward bulging of the rear end wall member of the bulk material cargo container liner, comprising:

a plurality of vertically spaced, horizontally oriented reinforcing straps;

a plurality of horizontally spaced, vertically oriented reinforcing straps crossing said plurality of horizontally oriented reinforcing straps so as to form with said plurality of horizontally oriented reinforcing straps a grid-type arrangement which comprises a plurality of intersection points defined between said plurality of vertically oriented reinforcing straps and said plurality of horizontally oriented reinforcing straps at locations at which said plurality of horizontally oriented reinforcing straps cross said plurality of vertically oriented reinforcing straps; and a plurality of tubular sleeve members through which said plurality of vertically oriented reinforcing straps are respectively and individually movably disposed, wherein said plurality of tubular sleeve members are fixedly attached to the rear end wall member of the bulk material cargo container liner substantially along their entire length, except at said plurality of intersection points defined between said plurality of vertically oriented reinforcing straps and said plurality of horizontally oriented reinforcing straps at said locations at which said plurality of horizontally oriented reinforcing straps cross said plurality of vertically oriented reinforcing straps, so as to define unattached portions of said tubular sleeve members which define a plurality of passageways through which said plurality of horizontally oriented reinforcing straps can respectively and individually pass, whereby said plurality of horizontally oriented reinforcing straps and said plurality of vertically oriented reinforcing straps are freely movable with respect to each other even at said plurality of intersection points forming said grid-type arrangement of said plurality of horizontally oriented reinforcing straps and said plurality of vertically oriented reinforcing straps.

2. The reinforcing strapping system as set forth in claim 1, wherein:

said plurality of tubular sleeve members, for mounting said plurality of vertically oriented reinforcing straps upon the rear end wall member of a bulk material cargo container liner permits said plurality of vertically oriented reinforcing straps to be movably adjustable with respect to each other and with respect to the rear end wall of the bulk material cargo container liner so as to permit the tension level within said plurality of vertically oriented reinforcing straps to be independently adjusted.

3. The reinforcing strapping system as set forth in claim 2, further comprising:

a first set of tension adjustment devices operatively connected to each one of said plurality of horizontally oriented reinforcing straps disposed upon the rear end wall member of a bulk material cargo container liner such that said plurality of horizontally oriented reinforcing straps are independently adjustable with respect to each other and with respect to the rear end wall of the bulk material cargo container liner so as to permit the tension level within said plurality of horizontally oriented reinforcing straps to be independently adjusted.

4. The reinforcing strapping system as set forth in claim 1, further comprising:

a second set of tension adjustment devices operatively connected to each one of said plurality of vertically oriented reinforcing straps disposed upon the rear end wall member of a bulk material cargo container liner such that said plurality of vertically oriented reinforcing straps are independently adjustable with respect to each other and with respect to the rear end wall of the bulk material cargo container liner so as to permit the tension level within said plurality of vertically oriented reinforcing straps to be independently adjusted.

5. In combination, a bulk material cargo container liner, and a reinforcing strapping system for use in connection with said bulk material cargo container liner in order to prevent the outward bulging of the rear end wall member of the bulk material cargo container liner, comprising:

a bulk material cargo container liner comprising a rear wall member, a front wall member, left and right side wall members, a top wall member, and a bottom wall member; and a reinforcing strapping system for use in connection with said bulk material cargo container liner in order to prevent the outward bulging of said rear end wall member of said bulk material cargo container liner;

said reinforcing strapping system comprising a plurality of vertically spaced, horizontally oriented reinforcing straps; a plurality of horizontally spaced, vertically oriented reinforcing straps crossing said plurality of horizontally oriented reinforcing straps so as to form with said plurality of horizontally oriented reinforcing straps a grid-type arrangement which comprises a plurality of intersection points defined between said plurality of vertically oriented reinforcing straps and said plurality of horizontally oriented reinforcing straps at locations at which said plurality of horizontally oriented reinforcing straps cross said plurality of vertically oriented reinforcing straps; and a plurality of tubular sleeve members through which said plurality of vertically oriented reinforcing straps are respectively and individually movably disposed, wherein said plurality of tubular sleeve members are fixedly attached to the rear end wall member of the bulk material cargo container liner substantially along their entire length, except at said plurality of intersection points defined between said plurality of vertically oriented reinforcing straps and said plurality of horizontally oriented reinforcing straps at said locations at which said plurality of horizontally oriented reinforcing straps cross said plurality of vertically oriented reinforcing straps so as to define unattached portions of said tubular sleeve members which define a plurality of passageways through which said plurality of horizontally oriented reinforcing straps can respectively and individually pass, whereby said plurality of horizontally oriented reinforcing straps and said plurality of vertically oriented reinforcing straps are freely movable with respect to each other even at said plurality of intersection points forming said grid-type arrangement of said plurality of horizontally oriented reinforcing straps and said plurality of vertically oriented reinforcing straps.

6. The combination as set forth in claim 5, further comprising:

said plurality of tubular sleeve members, for mounting said plurality of vertically oriented reinforcing straps upon the rear end wall member of a bulk material cargo container liner, permits said plurality of vertically oriented reinforcing straps to be movably adjustable with respect to each other and with respect to the rear end wall of the bulk material cargo container liner so as to permit the tension level within said plurality of vertically oriented reinforcing straps to be independently adjusted.

7. The combination as set forth in claim 6, further comprising:

a first set of tension adjustment devices operatively connected to each one of said plurality of horizontally oriented reinforcing straps disposed upon said rear end wall member of said bulk material cargo container liner such that said plurality of horizontally oriented reinforcing straps are independently adjustable with respect to each other and with respect to said rear end wall of said bulk material cargo container liner so as to permit the tension level within said plurality of horizontally oriented reinforcing straps to be independently adjusted.

8. The combination as set forth in claim 5, further comprising:

a second set of tension adjustment devices operatively connected to each one of said plurality of vertically oriented reinforcing straps disposed upon the rear end wall member of a bulk material cargo container liner such that said plurality of vertically oriented reinforcing straps are independently adjustable with respect to each other and with respect to the rear end wall of the bulk material cargo container liner so as to permit the tension level within said plurality of vertically oriented reinforcing straps to be independently adjusted.

9. The reinforcing strapping system as set forth in claim 1, further comprising:

a first set of fasteners respectively disposed upon opposite end portions of said plurality of horizontally oriented reinforcing straps for permitting said opposite end portions of said plurality of horizontally oriented reinforcing straps to be connected to interior portions of a bulk material cargo container within which the bulk material cargo container liner is disposed; and an encircling hoop strap respectively passing through said first set of fasteners disposed upon said opposite end portions of said plurality of horizontally oriented reinforcing straps, and adapted to be fixedly secured to the interior portions of the bulk material cargo container so as to secure said opposite end portions of said plurality of horizontally oriented reinforcing straps to the interior portions of the bulk material cargo container.

10. The reinforcing strapping system as set forth in claim 9, further comprising:

a second set of fasteners respectively disposed upon opposite end portions of said plurality of vertically oriented reinforcing straps for permitting said opposite end portions of said plurality of vertically oriented reinforcing straps to be connected to interior portions of a bulk material cargo container within which the bulk material cargo container liner is disposed;

said encircling hoop strap respectively passing through said second set of fasteners disposed upon said opposite end portions of said plurality of vertically oriented reinforcing straps so as to likewise secure said opposite end portions of said plurality of vertically oriented reinforcing straps to the interior portions of the bulk material cargo container.

11. The combination as set forth in claim 7, further comprising:

a first set of fasteners respectively disposed upon opposite end portions of said plurality of horizontally, oriented reinforcing straps for permitting said opposite end portions of said plurality of horizontally oriented reinforcing straps to be connected to interior portions of a bulk material cargo container within which the bulk material cargo container liner is disposed; and an encircling hoop strap respectively passing through said first set of fasteners disposed upon said opposite end portions of said plurality of horizontally oriented reinforcing straps, and adapted to be fixedly secured to the interior portions of the bulk material cargo container so as to secure said opposite end portions of said plurality of horizontally oriented reinforcing straps to the interior portions of the bulk material cargo container.

12. The combination as set forth in claim 11, further comprising:

a second set of fasteners respectively disposed upon opposite end portions of said plurality of vertically oriented reinforcing straps for permitting said opposite end portions of said plurality of vertically oriented reinforcing straps to be connected to interior portions of a bulk material cargo container within which the bulk material cargo container liner is disposed;

said encircling hoop strap respectively passing through said second set of fasteners disposed upon said opposite end portions of said plurality of vertically oriented reinforcing straps so as to likewise secure said opposite end portions of said plurality of vertically oriented reinforcing straps to the interior portions of the bulk material cargo container.

13. A reinforcing strapping system for use in connection with the rear end wall member of a bulk material cargo container liner in order to prevent the outward bulging of the rear end wall member of the bulk material cargo container liner, comprising:

a plurality of vertically spaced, horizontally oriented reinforcing straps;

a plurality of horizontally spaced, vertically oriented reinforcing straps crossing said plurality of horizontally oriented reinforcing straps so as to form with said plurality of horizontally oriented reinforcing straps a grid-type arrangement which comprises a plurality of intersection points defined between said plurality of vertically oriented reinforcing straps and said plurality of horizontally oriented reinforcing straps at locations at which said plurality of horizontally oriented reinforcing straps cross said plurality of vertically oriented reinforcing straps; and a plurality of tubular sleeve members through which said plurality of horizontally oriented reinforcing straps are respectively and individually movably disposed, wherein said plurality of tubular sleeve members are fixedly attached to the rear end wall member of the bulk material cargo container liner substantially along their entire length, except at said plurality of intersection points defined between said plurality of vertically oriented reinforcing straps and said plurality of horizontally oriented reinforcing straps at said locations at which said plurality of horizontally oriented reinforcing straps cross said plurality of vertically oriented reinforcing straps, so as to define unattached portions of said tubular sleeve members which define a plurality of passageways through which said plurality of vertically oriented reinforcing straps can respectively and individually pass, whereby said plurality of horizontally oriented reinforcing straps and said plurality of vertically oriented reinforcing straps are freely movable with respect to each other even at said plurality of intersection points forming said grid-type arrangement of said plurality of horizontally oriented reinforcing straps and said plurality of vertically oriented reinforcing straps.

14. The reinforcing strapping system as set forth in claim 13, wherein:

said plurality of tubular sleeve members, for mounting said plurality of horizontally oriented reinforcing straps upon the rear end wall member of a bulk material cargo container liner, permits said plurality of horizontally oriented reinforcing straps to be movably adjustable with respect to each other and with respect to the rear end wall of the bulk material cargo container liner so as to permit the tension level within said plurality of horizontally oriented reinforcing straps to be in-dependently adjusted.

15. The reinforcing strapping system as set forth in claim 14, further comprising:

a first set of tension adjustment devices operatively connected to each one of said plurality of horizontally oriented reinforcing straps disposed upon the rear end wall member of a bulk material cargo container liner such that said plurality of horizontally oriented reinforcing straps are independently adjustable with respect to each other and with respect to the rear end wall of the bulk material cargo container liner so as to permit the tension level within said plurality of horizontally oriented reinforcing straps to be independently adjusted.

16. The reinforcing strapping system as set forth in claim 13, further comprising:

a second set of tension adjustment devices operatively connected to each one of said plurality of vertically oriented reinforcing straps disposed upon the rear end wall member of a bulk material cargo container liner such that said plurality of vertically oriented reinforcing straps are independently adjustable with respect to each other and with respect to the rear end wall of the bulk material cargo container liner so as to permit the tension level within said plurality of vertically oriented reinforcing straps to be independently adjusted.

17. In combination, a bulk material cargo container liner, and a reinforcing strapping system for use in connection with said bulk material cargo container liner in order to prevent the outward bulging of the rear end wall member of the bulk material cargo container liner, comprising:

a bulk material cargo container liner comprising a rear wall member, a front wall member, left and right side wall members, a top wall member, and a bottom wall member; and a reinforcing strapping system for use in connection with said bulk material cargo container liner in order to prevent the outward bulging of said rear end wall member of said bulk material cargo container liner;

said reinforcing strapping system comprising a plurality of vertically spaced, horizontally oriented reinforcing straps; a plurality of horizontally spaced, vertically oriented reinforcing straps crossing said plurality of horizontally oriented reinforcing straps so as to form with said plurality of horizontally oriented reinforcing straps a grid-type arrangement which comprises a plurality of intersection points defined between said plurality of vertically oriented reinforcing straps and said plurality of horizontally oriented reinforcing straps at locations at which said plurality of horizontally oriented reinforcing straps cross said plurality vertically oriented reinforcing straps; and a plurality of tubular sleeve members through which said plurality of horizontally oriented reinforcing straps are respectively and individually movably disposed, wherein said plurality of tubular sleeve members are fixedly attached to the rear end wall member of the bulk material cargo container liner substantially along their entire length, except at said plurality of intersection points defined between said plurality of vertically oriented reinforcing straps and said plurality of horizontally oriented reinforcing straps at said locations at which said plurality of horizontally oriented reinforcing straps cross said plurality of vertically oriented reinforcing straps so as to define unattached portions of said tubular sleeve members which define a plurality of passageways through which said plurality of vertically oriented reinforcing straps can respectively and individually pass, whereby said plurality of horizontally oriented reinforcing straps and said plurality of vertically oriented reinforcing straps are freely movable with respect to each other even at said plurality of intersection points forming said grid-type arrangement of said plurality of horizontally oriented reinforcing straps and said plurality of vertically oriented reinforcing straps.

18. The combination as set forth in claim 17, further comprising:

said plurality of tubular sleeve members, for mounting said plurality of horizontally oriented reinforcing straps upon the rear end wall member of a bulk material cargo container liner, permits said plurality of horizontally oriented reinforcing straps to be movably adjustable with respect to each other and with respect to the rear end wall of the bulk material cargo container liner so as to permit the tension level within said plurality of horizontally oriented reinforcing strapsto be independently adjusted.

19. The combination as set forth in claim 18, further comprising:

a first set of tension adjustment devices operatively connected to each one of said plurality of horizontally oriented reinforcing straps disposed upon said rear end wall member of said bulk material cargo container liner such that said plurality of horizontally oriented reinforcing straps are independently adjustable with respect to each other and with respect to said rear end wall of said bulk material cargo container liner so as to permit the tension level within said plurality of horizontally oriented reinforcing straps to be independently adjusted.

20. The combination as set forth in claim 17, further comprising:

a second set of tension adjustment devices operatively connected to each one of said plurality of vertically oriented reinforcing straps disposed upon the rear end wall member of a bulk material cargo container liner such that said plurality of vertically oriented reinforcing straps are independently adjustable with respect to each other and with respect to the rear end wall of the bulk material cargo container liner so as to permit the tension level within said plurality of vertically oriented reinforcing straps to be independently adjusted.

* * * * *